US005227282A

United States Patent [19]

Tanaka et al.

[11] Patent Number: 5,227,282

[45] Date of Patent: Jul. 13, 1993

[54] LIGHT-SENSITIVE SILVER HALIDE COLOR PHOTOGRAPHIC MATERIAL HAVING IMPROVED CYAN IMAGE DENSITY

[75] Inventors: Shigeo Tanaka; Hirokazu Sato, both of Hino, Japan

[73] Assignee: Konica Corporation, Tokyo, Japan

[21] Appl. No.: 750,660

[22] Filed: Aug. 27, 1991

[30] Foreign Application Priority Data

Sep. 4, 1990 [JP] Japan ..... 2-234208

[51] Int. Cl.[5] ..... G03C 1/46; G03C 7/32

[52] U.S. Cl. ..... 430/505; 430/546; 430/554; 430/555; 430/556; 430/557; 430/558

[58] Field of Search ..... 430/505, 554, 555, 556, 430/557, 558, 504, 546

[56] References Cited

U.S. PATENT DOCUMENTS

| | | | |
|---|---|---|---|
| 4,921,783 | 5/1990 | Nakayama et al. | 430/558 |
| 4,994,362 | 2/1991 | Okumura et al. | 430/558 |
| 5,019,493 | 5/1991 | Sato et al. | 430/553 |
| 5,023,169 | 6/1991 | Hirabayashi et al. | 430/505 |

FOREIGN PATENT DOCUMENTS

| | | |
|---|---|---|
| 0283324 | 9/1988 | European Pat. Off. . |
| 0446060 | 9/1991 | European Pat. Off. . |
| 3245140 | 10/1991 | Japan . |

OTHER PUBLICATIONS

European Patent 320,778, Jun., 1989, pp. 3, 33, 36, 39.

*Primary Examiner*—Hoa Van Le
*Assistant Examiner*—Janet C. Baxter
*Attorney, Agent, or Firm*—Frishauf, Holtz, Goodman & Woodward

[57] ABSTRACT

Disclosed is a light-sensitive silver halide color photographic material having at least three kinds of silver halide emulsion layers with different color sensitivities on a reflective support and also having yellow, magenta and cyan color forming couplers for forming colors related to developing of said silver halide emulsions, characterized in that when the coupler for forming color related to said color sensitive silver halide emulsion bearing primarily cyan color image is color formed to a cyan image density of 0.4, the color difference (color difference $\Delta E$ in the CEI 1976 L*a*b* color space) from the minimum density is $\Delta E \geqq 23$.

8 Claims, No Drawings

LIGHT-SENSITIVE SILVER HALIDE COLOR PHOTOGRAPHIC MATERIAL HAVING IMPROVED CYAN IMAGE DENSITY

BACKGROUND OF THE INVENTION

This invention relates to a light-sensitive silver halide color photographic material which is high in sensitivity, excellent in gradation reproducibility, color reproducibility, ground whiteness and gives a sharp print image, more particularly to a light-sensitive silver halide color photographic material excellent in description of three-dimensional feel such as brilliant red cloth or face, etc. or details.

In the present invention, the light-sensitive silver halide emulsion layer bearing primarily cyan color image formation means a silver halide emulsion layer having a color sensitivity bearing the highest image density when the silver halide emulsion layers in which cyan color forming coupler forms color related to developing of said silver halide emulsion layer are classified according to color sensitivity. When there are a plurality of layers of silver halide emulsion layers having substantially the same color sensitivity, the color difference from the minimum density portion when the coupler which forms color related to developing of the whole of these layers is color formed to an image density of 0.4 may be questioned.

As the cyan color forming coupler which can be used in the light-sensitive silver halide color photographic material according to the present invention, any coupler which can give the color difference between the color formed portion and the minimum density portion when this is color formed alone to a density of 0.4 (color difference $\Delta E$ in the CIE 1976 L*a*b* color space) of $\Delta E \geqq 23$ by use of a light-sensitive silver halide color photographic material having a reflective support can be preferably used. Of course, although it is possible to use a mixture of cyan color forming couplers under the conditions which satisfy the above-mentioned conditions, but it is not preferable to mix a coupler of another hue therein.

The color difference between the color forming portion and the minimum density is obtained by exposing the light-sensitive silver halide color photographic material to a light with an appropriate spectral composition, developing this and unexposed sample at the same time and determining the three stimulative values X, Y, Z of the color patch obtained according to the method described in JIS Z-8722, determining the respective values of L*a*b* according to the method described in JIS Z-8729, and further determining the color difference according to the method described in JIS Z 8730.

Even if a color patch with a cyan image density of 0.4 cannot be obtained, provided that color patches with two concentrations sandwiching this therebetween is obtained and the density difference is sufficiently small, the color difference at 0.4 can be estimated with sufficient precision.

Light-sensitive silver halide color photographic material has been used today very abundantly because it has high sensitivity as well as excellent color reproducibility and sharpness. Particularly, recently, there are remarkable improvements of color reproducibility with a color negative by use of a novel DIR compound. Also, in color paper, there has been made improvement of reproducibility by employment of a pyrazoloazole type magenta coupler or improvement of sharpness by employment of a novel anti-irradiation dye, improvement of original paper, which improvement contributing to color reproducibility, sharpness.

Generally speaking, gradation, color reproducibility, sharpness of-color print image are related to each other, and if gradation is harder in tone, the color reproduced becomes more sharp, whereby the image appears to be sharper. For this reason, in the field of photography for amateur, from the standpoint of ideal gradation reproducibility, the design is becoming to be made toward the side of hard tone, and the improvements of the performances as mentioned above have not still reached the stage where scramble between these performances and gradation is cancelled under the present situation. This is partly because, when a large amount of an anti-irradiation dye is employed, there are such drawbacks that the dye may sometimes remain in the treated print to deteriorate the white ground, lower the sensitivity of the light-sensitive material, that the photographic performances are susceptible to temperature and humidity during exposure, whereby no sufficient improvement effect could be obtained.

By use of a color negative with intensified interimage effect, a problem has been newly caused to occur that reproduction of delicate shade at red high density portion cannot be effected (red saturation phenomenon), etc. Also, separately from this, such problem as deficient three-dimensional feel of human face in group portrait of persons has been pointed out, and such performances have not been sufficiently improved according to the method as described above.

As a method for improving the red saturation phenomenon as mentioned above, Published Technical Report 85-3445 and Japanese Unexamined Patent Publication No. 91657/1986 disclose a light-sensitive material which adds a dye which does not substantially contribute to hue formation of the image in a region with a constant value of the density of at least one image dye set between 1.2–2.5 so as to have a gradation. More specifically, there are disclosed the method in which a limited green-sensitivity is imparted by adding a limited amount of a green-sensitive sensitizing dye to a red-sensitive emulsion containing a cyan color formable coupler, the method in which in a sensitive material having green-sensitive layers of high sensitivity and low sensitivity, a limited amount of a cyan color forming coupler is incorporated in the low sensitivity emulsion layer, the method in which the color mixing prevention ability of the intermediate layer is made limited, the method in which developing of the photographic emulsion in the cyan color forming coupler containing layer is accelerated by use of a development accelerating agent releasing coupler in the low sensitivity emulsion layer, etc.

Japanese Unexamined Patent Publication No. 67537/1987 discloses a light-sensitive material, which is a light-sensitive material having a plurality of light-sensitive layers with the same color sensitivity and contains in the emulsion layer bearing the high density region and/or the adjacent non-light-sensitive layer at least one coupler which forms color to different hues in at a relative coupling speed to the coupler contained in the emulsion layer may be 0.7 to 0.01 in such amount that the maximum color formed density may be 0.03 to 0.40.

Otherwise, Japanese Unexamined Patent Publications Nos. 258453/1987, 68754/1989, 100046/1990, 129628/1990, etc. disclose similar techniques.

However, these techniques mean ultimately mixing other dyes in the place where the color formed amounts of the respective dyes of Y, M, C corresponding to the complement colors depending on the amounts of the three primary colors of B, G, R should be controlled, and it has been extremely difficult to control gradation without accompaniment of deterioration of color reproducibility. Particularly, when printing is effected from a color negative utilizing the strong interimage effect which is liable to cause red saturation phenomenon to occur, in a scene of an artificial landscape such as playland, even the drawback that the red color with high chromaticity may be reproduced to a color which is dark and low in chromaticity may be sometimes conspicuous.

SUMMARY OF THE INVENTION

An object of the present invention is to provide a light-sensitive silver halide color photographic material which is high in sensitivity, excellent in gradation reproducibility, color reproducibility, ground whiteness, and gives a sharp print image.

The present inventors, in view of the state of the art as described above have studied intensively, and consequently have found that gradation reproducibility, color reproducibility, ground whiteness can be excellent, and description of three-dimensional feel of brilliant red cloth or face or details can be improved by a light-sensitive silver halide color photographic material having at least three kinds of silver halide emulsion layers with different color sensitivities on a reflective support and also having yellow, magenta and cyan color forming couplers for forming colors related to developing of said silver halide emulsions, wherein when the coupler for forming color related to said color sensitive silver halide emulsion bearing primarily cyan color image is color formed to a cyan image density of 0.4, the color difference (color difference ΔE in the CEI 1976 L*a*b* color space) from the minimum density is ΔE ≧23, to accomplish the present invention.

DETAILED DESCRIPTION OF THE INVENTION

As the yellow and magenta color forming couplers preferably used in the light-sensitive silver halide color photographic material according to the present invention, couplers presently known can be combined, but as the yellow coupler, the compounds represented by the following formula [Y - I] are preferred.

Formula [Y-I]

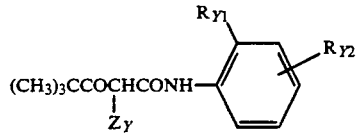

In the formula $R_{Y1}$ represents a halogen atom or an alkoxy group, $R_{Y2}$ represents $-NHCOR_{Y3}SO_2R_{Y4}$, $-COOR_{Y4}$, $-NHCOR_{Y4}$, $-COOR_{Y3}COOR_{Y4}$, $$-\underset{\underset{R_{Y5}}{|}}{NSO_2R_{Y4}} \text{ or } -\underset{\underset{R_{Y5}}{|}}{SO2R_{Y4}}.$$

$R_{Y3}$ represents an alkylene group, $R_{Y4}$ represents a diffusion resistant group, $R_{Y5}$ represents hydrogen atom, an alkyl group or an aralkyl group, and $Z_Y$ represents a coupling elimination group.

Specific examples of the yellow coupler preferably used in the present invention are mentioned below, but the present invention is not limited to these.

YC-1

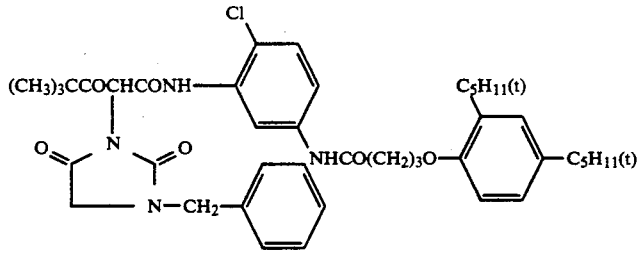

YC-2

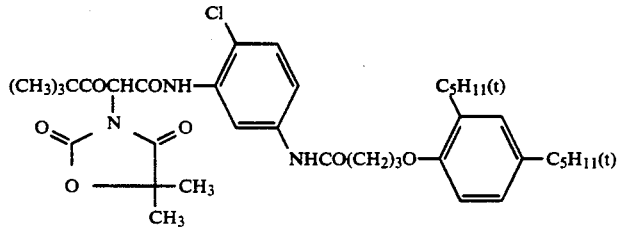

-continued
YC-3
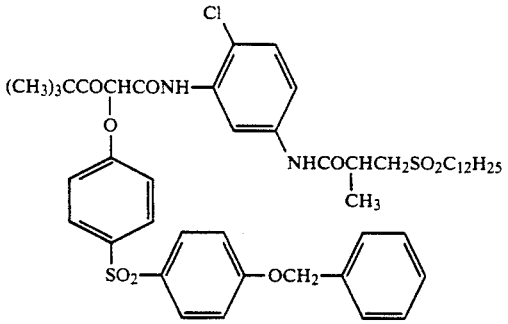
YC-4
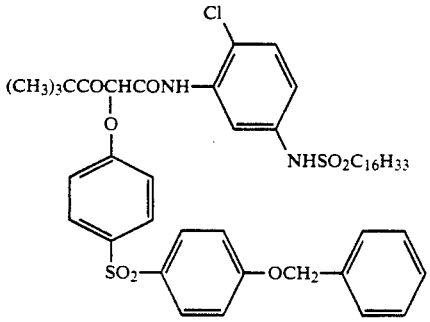
YC-5
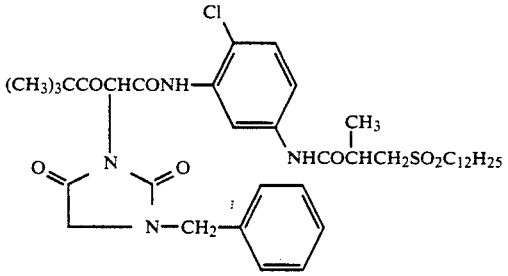
YC-6
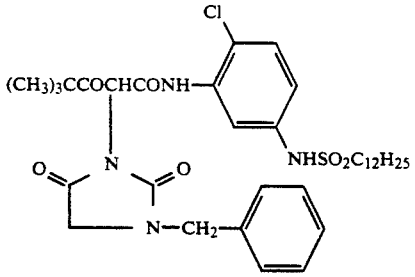
YC-7
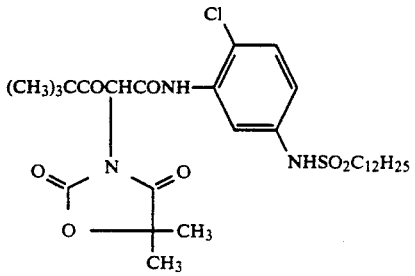

-continued

YC-8

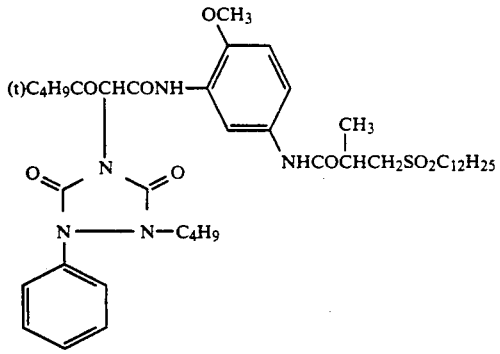

YC-9

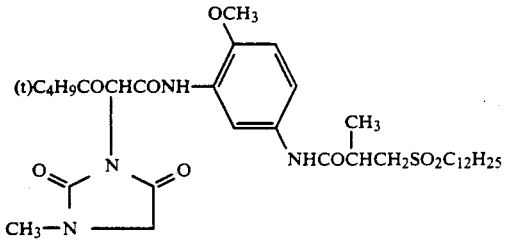

As the magenta coupler preferably used in the present invention, the magenta couplers represented by the following formulae [M - I] and [M - II] may be included.

Formula [M-I]

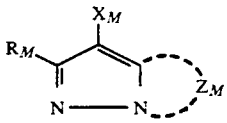

In the formula, $Z_M$ represents a group of non-metallic atoms necessary for formation of a nitrogen-containing heterocyclic ring, and the ring formed by said $Z_M$ may also have a substituent.

$X_M$ represents hydrogen atom or a group eliminable through the reaction with the oxidized product of a color developing agent.

$R_M$ represents a hydrogen atom or a substituent.

Formula [M-II]

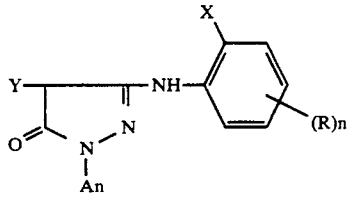

In the formula, $Ar_1$ represents an aryl group, X represents a halogen atom, an alkoxy group or an alkyl group, R represents a group substitutable on benzene ring. n represents 1 or 2. When n is 2, R's may be the same groups or different groups.

Y represents a group eliminable through the coupling reaction with the oxidized product of an aromatic primary amine type color developing agent.

Specific examples of the magenta coupler preferably used in the present invention are mentioned below, but the present invention is not limited to these.

MC-1

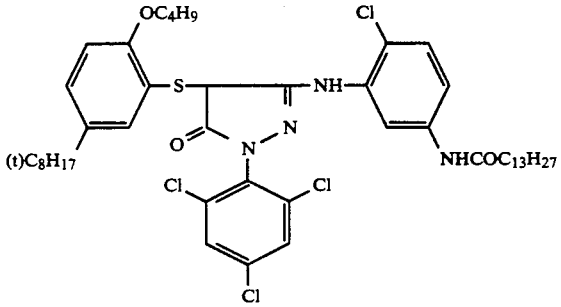

-continued
MC-2
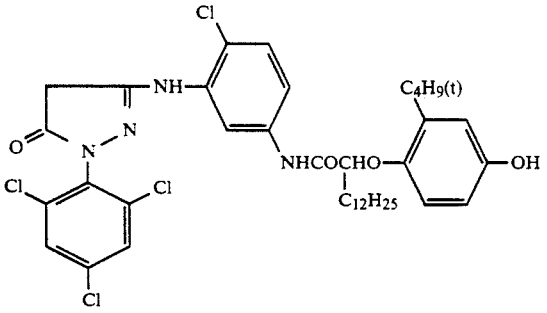
MC-3
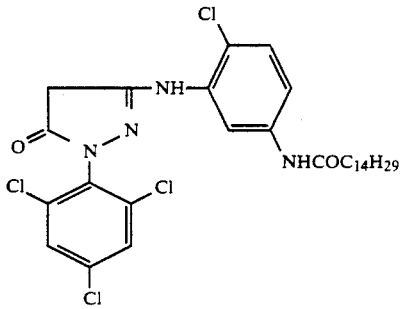
MC-4
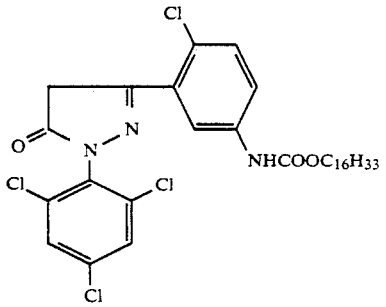
MC-5
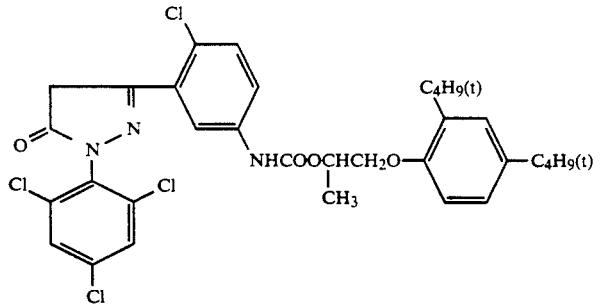
MC-6
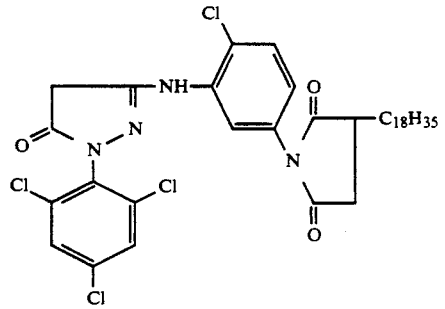

-continued

MC-7

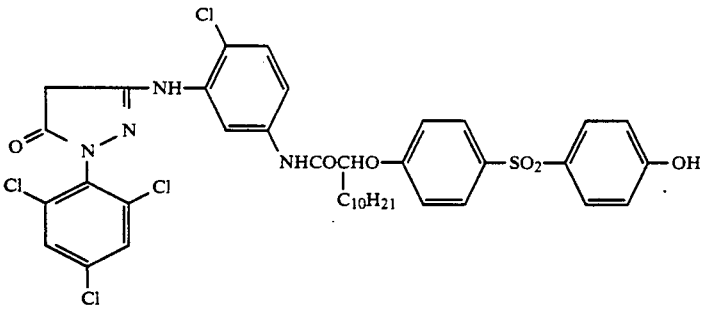

MC-8

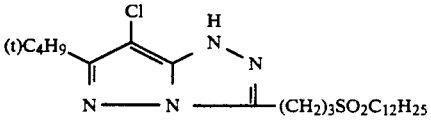

MC-9

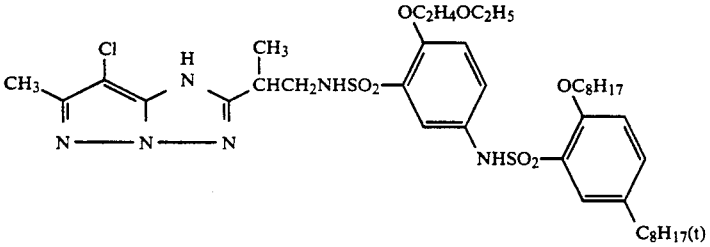

MC-10

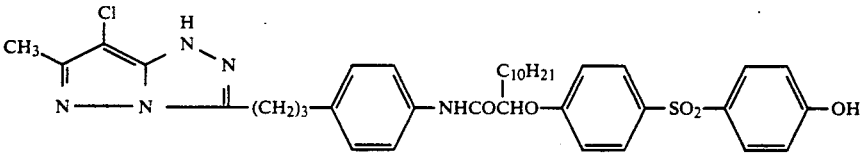

MC-11

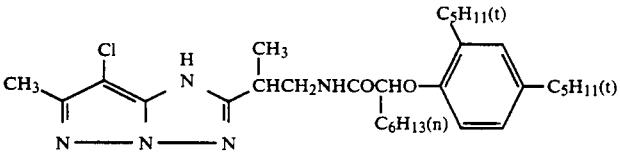

The cyan color forming coupler to be used in the present invention may be used along, or a plurality of couplers may be also used in combination. However, in order to satisfy the condition of $\Delta E \geqq 23$ when the cyan image density is 0.4, it is advantageous to use many couplers which satisfy the above condition as the individual cyan couplers.

As prefrable couplers which can be used in combination, the cyan couplers represented by the following formulae [C-I] and [C-II] may be included.

Formula [C-I]

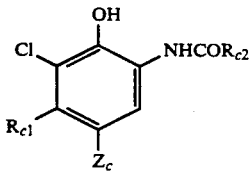

In the formula, $R_{c1}$ represents an alkyl group having 2 to 6 carbon atoms.

$R_{c2}$ represents a ballast group. $Z_c$ represents a hydrogen atom, or an atom or a group eliminable through the reaction with the oxidized product of a color developing agent.

Formula [C-II]

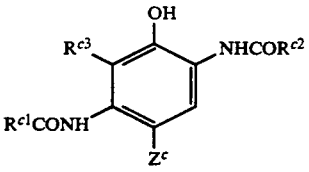

In the formula, $R^{c1}$ represents an alkyl group or an aryl group. $R^{c2}$ represents an alkyl group, a cycloalkyl group, an aryl group or a heterocyclic group. $R^{c3}$ represents hydrogen atom, a halogen atom, an alkyl group or an alkoxy group. Also, $R^{c3}$ and $R^{c1}$ taken together may form a ring.

$Z^c$ represents hydrogen atom or an eliminable group through the reaction with the oxidized product of a color developing agent.

As the cyan coupler which can be used in combination, the compounds as shown below may be included.

CC-1
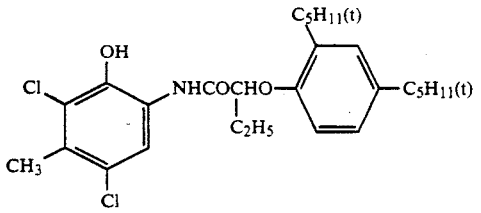
CC-2
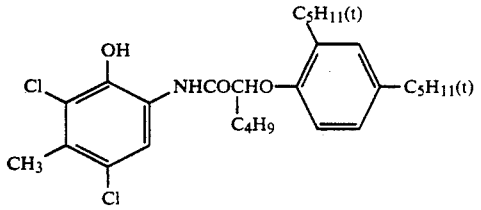
CC-3
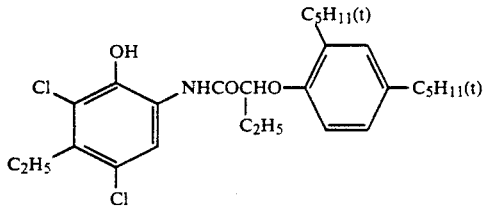
CC-4
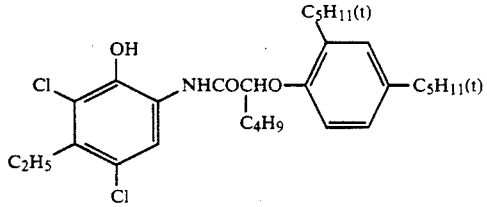
CC-5
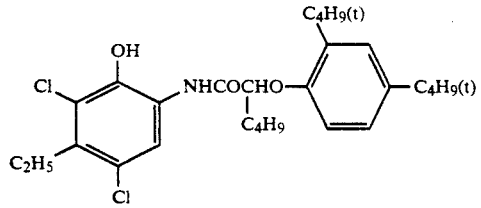
CC-6
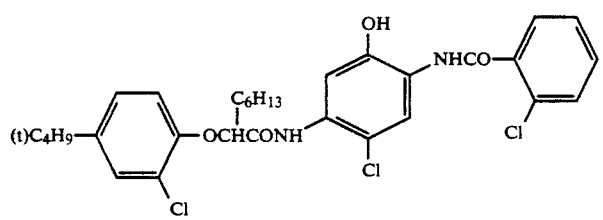
CC-7
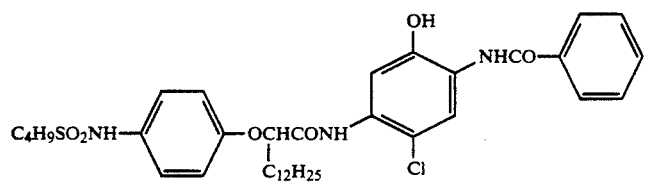

-continued
CC-8
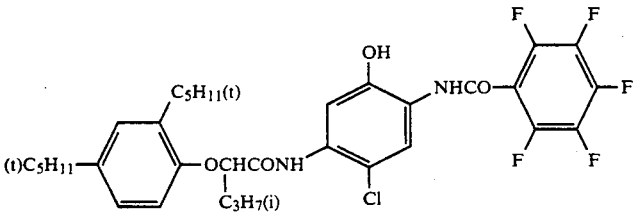
CC-9
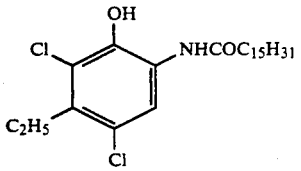
CC-10
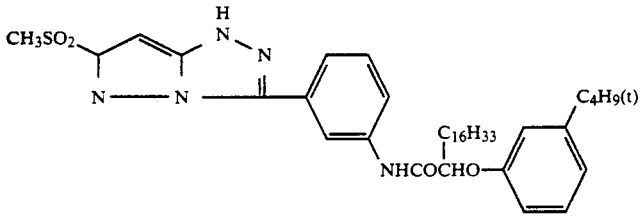
CC-11
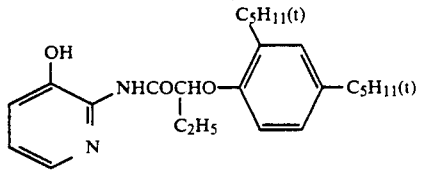
As the compound which can be used alone in the light-sensitive silver halide color photogaphic material according to the present invention to exhibit its effect, the following specific examples can be included, which are not limitative of the present invention.
CC-12
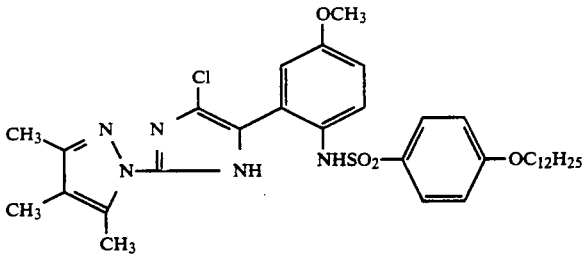
CC-13
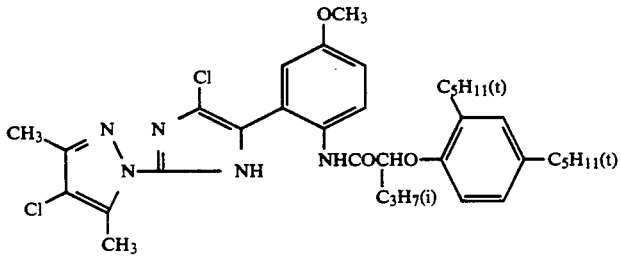

-continued

CC-14

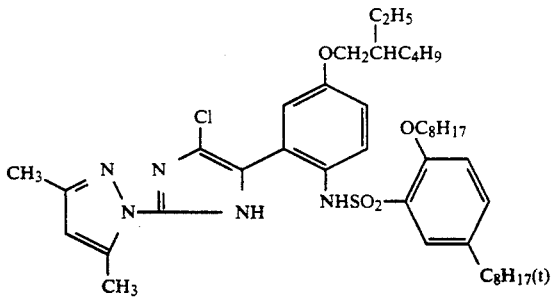

When the oil-in-water type emulsification method is employed for adding the above coupler, etc. into a silver halide emulsion, usually it is dissolved in a water-insoluble high boiling organic solvent with a boiling point of about 150° C. or higher by using, if necessary, a low boiling and/or water-soluble organic solvent in combination, emulsifying the solution into a hydrophilic binder such as an aqueous gelatin solution, etc. by use of a surfactant by means of a dispersing means such as stirrer, homogenizer, colloid mill, flow jet mixer, sonication device, etc. and then adding the emulsion into the desired photographic constituting layer (hydrophilic colloid layer).

After the dispersion, or simultaneously, the step of removing the low boiling organic solvent may be also incorporated.

As the high boiling solvent to be used for such purpose, there may be preferably employed phthalates such as dibutyl phthalate, di-2(ethylhexyl) phthalate, dinonyl phthalate, dicyclohexyl phthalate and the like; phosphates such as tricresyl phosphate, tri(2-ethylhexyl) phosphate, diphenyl-cresyl phosphate, trihexyl phosphate and the like; organic acid amides such as diethyl lauramide, dibutyl lauramide and the like; phenols such as dinonylphenol, p-dodecylphenol and the like; hydrocarbons such as decalin, dodecylbenzene and the like; esters such as 1,4-bis(2-ethylhexylcarbonyloxymethyl)-cyclohexane, dinonyl adipate, etc. Among them, organic acid esters such as of phthalic acid, phosphoric acid others may be more preferably employed. These high boiling organic solvents may be employed either as a single kind or a combination of two or more kinds.

As the polymer insoluble in water and soluble in organic solvents which is used for dispersing the compound represented by the formula [I] and couplers, etc., there may be included:

(1) vinyl polymers and copolymers,
(2) polycondensates of polyhydric alcohols and polybasic acids,
(3) polyesters obtained by ring-opening polymerization method, and
(4) others such as polycarbonate resins, polyurethane resins, polyamide resins, etc.

The number average molecular weight of these polymers is not particularly limited, but may be preferably 200,000 or less, more preferably 5,000 to 100,000. The ratio (weight ratio) of the polymer to the coupler may be preferably 1:20 to 20:1, more preferably 1:10 to 10:1.

In the following, specific examples of the polymer preferably employed are shown.

The copolymer is shown in terms of the weight ratio of the monomers.

(PO-1) poly(N-t-butylacrylamide)
(PO-2) N-t-butylacrylamide-methyl methacrylate copolymer (60:40)
(PO-3) polybutyl methacrylate
(PO-4) methyl methacrylate-styrene copolymer (90:10)
(PO-5) N-t-butylacrylamide-2-methoxyethyl acrylate copolymer (55:45)
(PO-6) ω-methoxypolyethylene glycol acrylate (added moles n=9)-N-t-butylacrylamide copolymer (25:75)
(PO-7) 1,4-butane diol-adipic acid polyester
(PO-8) polypropiolactam In the light-sensitive material according to the present invention, various compounds can be used for enhancing the durability of the image dyes. Among them, the compound represented by the following formulae [a] to [c] can be preferably employed without such drawbacks as lowering color formability of the coupler or impairing the effect of the present invention.

Formula [a]

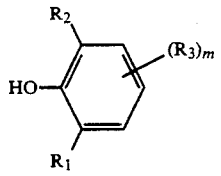

In the formula, $R_1$ and $R_2$ each represent an alkyl group. $R_3$ represents an alkyl group, —NR'R" group, —SR' group (R' represents a monovalent organic group) or —COOR" group (R" represents hydrogen atom or a monovalent organic group).

m represents an integer of 0 to 3.

Formula [b]

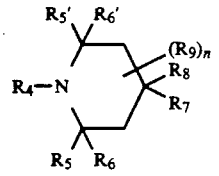

In the formula, $R_4$ represents hydrogen atom, hydroxyl group, oxyradical group (—O group), —SOR' group, —$SO_2$R' group (R' represents a monovalent organic group), an alkyl group, an alkenyl group or alkynyl group or —COR" group (R" represents hydrogen atom or a monovalent organic group).

$R_5$, $R_6$, $R_5'$, $R_6'$ and $R_9$ each represent an alkyl group.

$R_7$ and $R_8$ each represent hydrogen atom or —O-$COR_{10}$ group ($R_{10}$ represents a monovalent organic group), or $R_7$ and $R_8$ taken together may also form a heterocyclic group. n represents an integer of 0 to 4.

Formula (c)

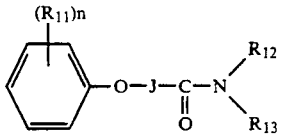

In the formula $R_{11}$ represents an alkyl group or an alkoxy group, J represents an alkylene group, $R_{12}$ and $R_{13}$ each represent an alkyl group. n represents an integer of 1 to 3, and when n is 2 or more, $R_{11}$'s may be either the same or different.

Otherwise, the dye image stabilizers as shown by the formulae [III], [IV], [V] and [VI] described in Japanese Patent Application No. 51124/1990, on pages 71-94, can be used.

In the present invention, by it is also possible to use various compounds which change the spectral absorption of the dye formed by addition into the light-sensitive material dissolved or dispersed together with the coupler. For example, they are compounds represented respectively by the following formulae [d - I] to [d - IV] described in Japanese Unexamined Patent Publications Nos. 167357/1988, 167358/1988, 231340/1988 and 256952/1988.

$R_{21}O-(CH_2-J_1-CH_2O)_l-R_{22}$ Compound [d-I]

In the formula, $R_{21}$ and $R_{22}$ each represent an aliphatic group or —COR' (R' represents an aliphatic group), $J_1$ represents a divalent organic group or a mere bonding arm, and λ represents an integer of 0 to 6.

Compound having two or more $-\underset{R_A}{N}-\underset{O}{C}-$ groups ($R_A$ represents an alkyl group, an alkenyl group or an aryl group. Compound [d-II]

$R_{23}O-(CO)_l-J_2-COOR_{24}$ Compound [d-III]

In the formula, $R_{23}$ and $R_{24}$ each represent an aliphatic group or a nigrogen-containing heterocyclic group, $J_2$ represents a divalent organic group, and λ represents 0 or 1.

Compound [d-IV]

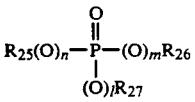

In the formula, $R_{25}$, $R_{26}$ and $R_{27}$ each represent an aliphatic group or an aromatic group, λ, m and n each represent 0 or 1. However, λ, m and n can not be 1 at the same time.

In the compound [d - I], examples of the aliphatic groups represented by $R_{21}$ and $R_{22}$ may include alkyl groups having 1 to 32 carbon atoms, alkenyl groups, alkynyl groups, cycloalkyl groups, cycloalkenyl groups, etc. Alkyl groups, alkenyl groups and alkynyl groups may be either straight or branched. Also, these aliphatic groups are inclusive of those having substituents.

In —COR', R' represents an aliphatic group, as exemplified by similar ones shown by the examples of the aliphatic groups represented by the above $R_{21}$ and $R_{22}$.

As the divalent organic group represented by $J_1$, alkylene groups, cycloalkylene groups, carbonyl groups, carbonyloxy groups, etc. may be included, and these groups may also have substituents.

In the compound [d - II], particularly preferable examples are compounds represented below by the formulae [1] to [4], Formula (1)

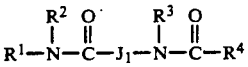

Formula (2)

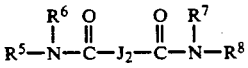

Formula (3)

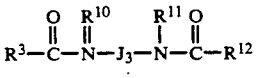

Formula (4)

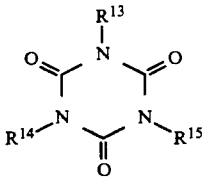

In the formula, $R^1$, $R^2$, $R^3$, $R^5$, $R^6$, $R^7$, $R^8$, $R^{10}$, $R^{11}$, $R^{13}$, $R^{14}$ and $R^{15}$ each represent an alkyl group, an alkenyl group or an aryl group, $R^4$, $R^9$ and $R^{12}$ each represent an alkyl group, an alkenyl group, an aryl group, an alkoxy group or

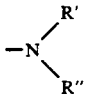

(R' and R'' each represent hydrogen atom or an alkyl group), $J_1$, $J_2$ and $J_3$ each represent a divalent organic group.

In the compound [d - III], examples of the aliphatic groups represented by $R^{23}$ and $R^{24}$ may include alkyl groups having 1 to 32 carbon atoms, alkenyl groups, alkynyl groups, cycloalkyl groups, cycloalkenyl groups, etc. Alkyl groups, alkenyl groups and alkynyl groups may be either straight or branched. Also, these aliphatic groups are inclusive of those having substituents.

Examples of the nitrogen-containing heterocyclic group represented by $R^{23}$ and $R^{24}$ may include pyrrolyl group, pyrazolyl group, imidazolyl group, pyridyl group, pyrollinyl group, imidazolidinyl group, imidazolinyl group, piperadinyl group, piperidinyl group, etc., and these are also inclusive of those having substituents.

As the divalent organic group represented by $J_2$, there may be included alkylene group, alkenylene group, cycloalkylene group, carbonyl group, carbonyloxy group, etc., and these groups may also have substituents.

In the compound [d - IV], examples of the aliphatic groups represented by $R^{25}$, $R^{26}$ and $R^{27}$ may include alkyl groups having 1 to 32 carbon atoms, alkenyl groups, alkynyl groups, cycloalkyl groups, cycloalkenyl groups, etc. Alkyl groups, alkenyl groups and alkynyl groups may be either straight or branched. Also, these aliphatic groups are inclusive of those having substituents.

Examples of the aromatic groups represented by $R^{25}$, $R^{26}$ and $R^{27}$ may include aryl groups, aromatic heterocyclic groups, etc., preferably alkyl groups or aryl groups. Also, these aromatic groups are inclusive of those having substituents.

Representative specific examples of the compounds represented by the above [d - I] to [d - IV] are shown below.

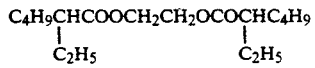
d-1

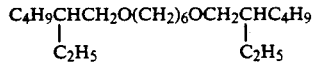
d-2

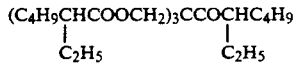
d-3

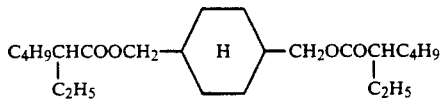
d-4

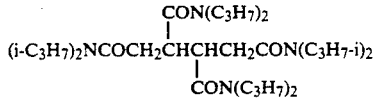
d-5

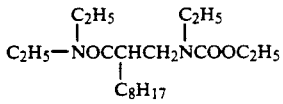
d-6

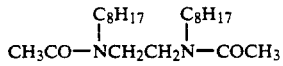
d-7

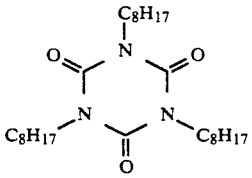
d-8

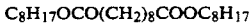
d-9

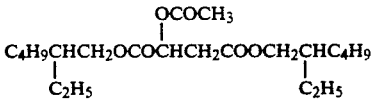
d-10

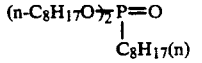
d-11

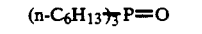
d-12

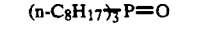
d-13

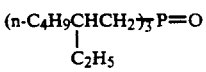
d-14

As the compounds represented by the above [d - I] to [d - IV], in addition to the above exemplary compounds, the compounds other than the above exemplary compounds described in Japanese Unexamined Patent Publication No. 167357/1988, on pages 32–43, No. 167358/1988 on pages 32–39, Japanese Unexamined Patent Publication No. 231340/1988, on pages 32–40 and No. 256952/1988 on pages 28–42 can be also included.

The contents of the compounds represented respectively by the above [d - I] to [d - IV] in the light-sensitive material may be preferably 5 to 500 mole %, more preferably 10 to 300 mole % based on the coupler.

In the present invention, together with the above formulae [d - I] to [d - IV] or separately from these, the compound represented by the following formula [A'] can be used.

$$R_1'—NHSO_2—R_2' \qquad \text{Formula [A']}$$

In the formula, $R'_1$ and $R'_2$ are each an alkyl group or an aryl group, and these groups are also inclusive of substituted ones. More preferably, at least one of $R'_1$ and $R'_2$ is aryl group. Most preferably, $R'_1$ and $R'_2$ are both aryl groups, particularly preferably phenyl groups. Here, when $R'_1$ is phenyl group, it is particularly preferable that the Hammet op value of the substituent at the para-position of sulfonamide group should be −0.4 or more.

Examples of the alkyl group represented by $R'_1$ and $R'_2$ can include those having 1 to 32 carbon atoms, namely group such as methyl, ethyl, butyl, nonyl, decyl or the like.

As the aryl group represented by $R'_1$, $R'_2$, phenyl groups are preferable, and phenyl groups substituted with halogen atoms such as chlorine, bromine, fluorine, etc., alkoxy groups such as methoxy, butoxy, dodecyloxy, etc., alkyl groups such as methyl, butyl, dodecyl, etc. are preferred.

In the following, representative examples of the compound represented by the above formula [A'] are shown.

A'-1

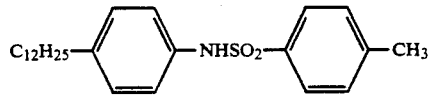

A'-2

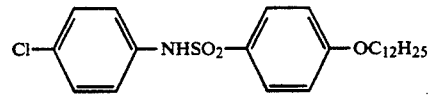

A'-3

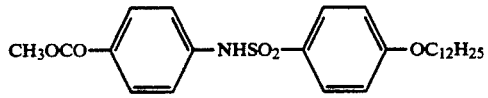

A'-4

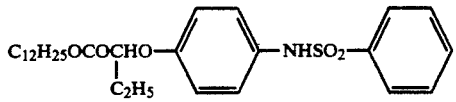

A'-5

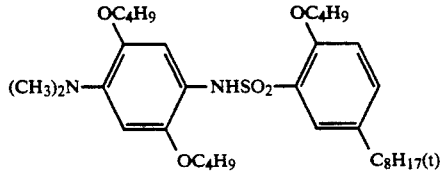

-continued

A'-6

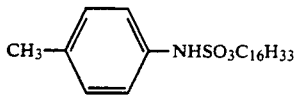

A'-7

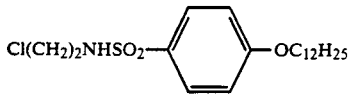

A'-8

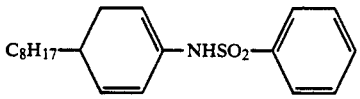

As the means for controlling the spectral absorption other than these, fluorescent dye release compounds described in U.S. Pat. No. 4,774,187 can be used.

These high boiling organic solvents or the polymer, the spectral absorption controller to be used for dispersion can be controlled in their amounts, ratio and the coated amounts including the coupler depending on the kind of the cyan color forming coupler, whereby the effect of the present invention can be obtained by making $\Delta E \geqq 23$ when the density of the cyan color forming image is 0.4.

The silver halide emulsion to be used in the present invention may be either one of silver chloride, silver bromide, silver iodide, silver chlorobromide, silver chloroiodide, silver iodobromide, silver chloroiodobromide.

The composition of the silver halide grains of the present invention may be either uniform from the inner portion to the outer portion of the grains, or different in the composition of the inner portion and that of the outer portion. When the compositions in the inner portion and the outer portion are different, the composition may be varied either continuously or incontinuously.

The grain size of the silver halide grains of the present invention is not particularly limited, but in view of rapid processability and sensitivity, and other photographic performances, etc. it may be preferably within the range of 0.2 to 1.6 μm, more preferably 0.25 to 1.2 μm.

The distribution of the grain sizes of the silver halide grains of the present invention may be either poly-dipersed or mono-dispersed.

As the preparation device, method of the silver halide emulsion, various methods known in this field of the art can be used.

The silver halide grains to be used in the emulsion of the present invention may be obtained according to any of the acidic method, the neutral method, the ammonia method. Said grains may be grown at one time, or alternatively grown after preparation of seed grains. The method for preparing seed grains and the method for growing grains may be either the same or different.

The silver halide grains according to the present invention may have any desired shape. A preferable example is a cubic body with the {100} plane being faced as the crystal surface. According to the methods as described in the literatures such as U.S. Pat. Nos. 4,183,756, 4,225,666, Japanese Unexamind patent Publication No. 26589/1980, Japanese Patent Publication No. 42737/1980, or The Journal of Photographic Science (J. Photgr. Sci), 21, 39 (1973), grains having shapes such as octahedral, tetradecahedral, dodecahedral bodies may be also made and provided for use. Further, grains having twin crystal plane may be also used.

The silver halide grains according to the present invention may employ grains comprising a single shape, or a mixture of grains with various shapes.

In the light-sensitive silver halide photographic material of the present invention, dyes having absorptions in various wavelength regions can be used for the purpose of preventing irradiation, halation or for the purpose of controlling sensitivity.

For this purpose, any of known compounds can be used.

In the light-sensitive silver halide photographic material according to the present invention, color antifoggants, film hardeners, plasticizers, polymer latices, UV-ray absorbers, formalin scavenger, developing accelerators, developing retarders, fluorescent brighteners, matte agents, lubricants, antistatic agents, surfactants, etc. can be used as desired.

The emulsion of the present invention can be chemically sensitized in conventional manner. That is, there can be employed the sulfur sensitization method by use of a sulfur-containing compound which can react with silver ions or active gelatin, the selenium sensitization method by use of a selenium compound, the reducing sensitization method by use of a reductive substance either singly or in a combination.

The light-sensitive silver halide photographic material according to the present invention has a layer containing a silver halide emulsion layer spectrally sensitized to a specific region of the wavelength region of 400 to 900 nm by combination with a yellow color forming coupler, a magenta color forming coupler and a cyan color forming coupler. Said silver halide emulsion contains one kind or a combination of two or more kinds of sensitizing dyes.

A strengthening sensitizer which is a dye having itself no spectral sensitizing action or a compound absorbing substantially no visible light and strengthens the sensitizing action of the sensitizing dye may be also contained in the emulsion.

In the following, specific examples of preferable compounds as the blue-sensitive sensitizing dye are shown.

BS-1

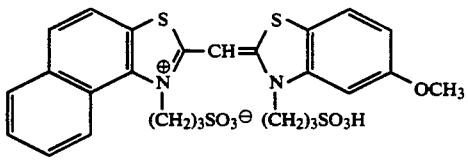

BS-2

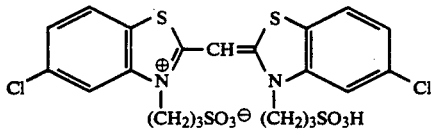

BS-3

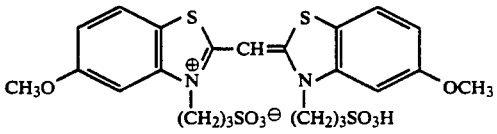

-continued
BS-4
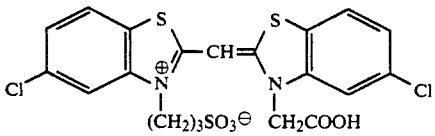
BS-5
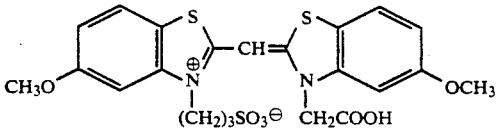
BS-6
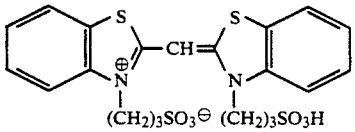
BS-7
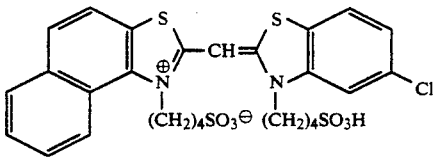
-continued
BS-8
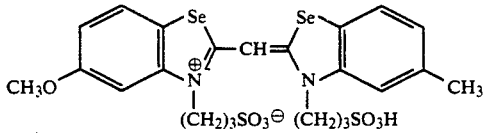
BS-9
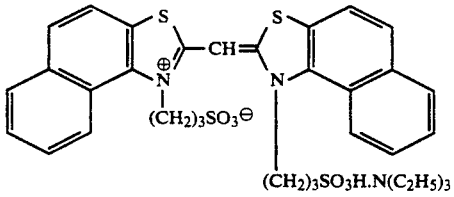
Preferable compounds as the green-sensitive sensitizing dye may include those shown below.
GS-1
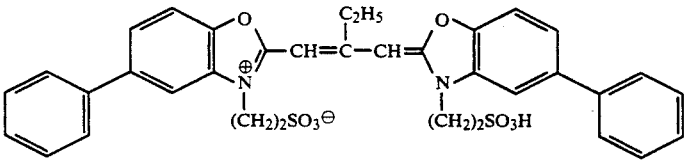
GS-2
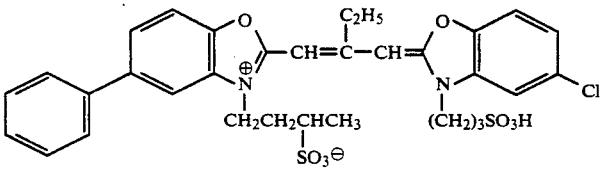
GS-3
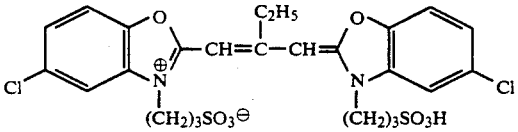
GS-4
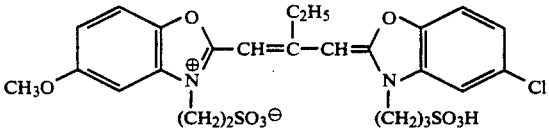
GS-5
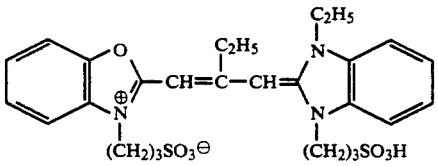
Preferable compounds as the red-sensitive sensitizing dye may include those shown below.

RS-1
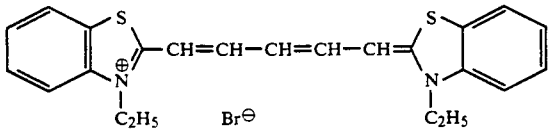
RS-2
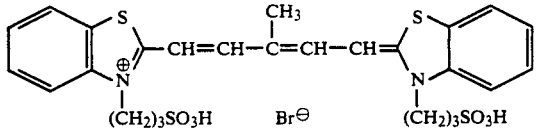
RS-3
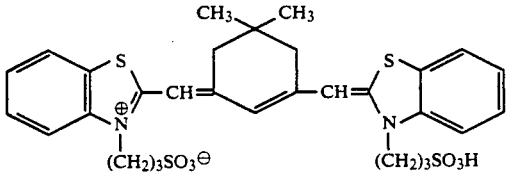
RS-4
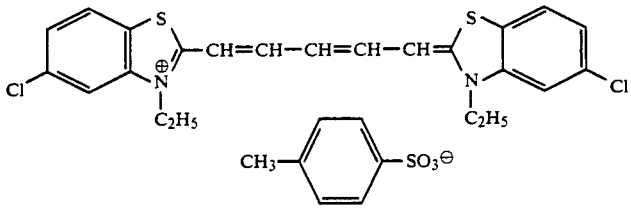
RS-5
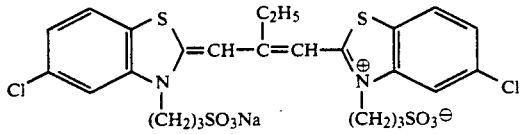
RS-6
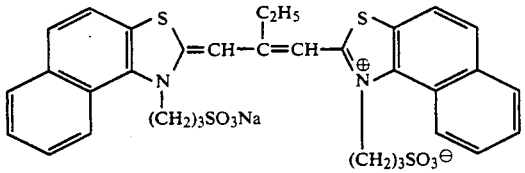
RS-7
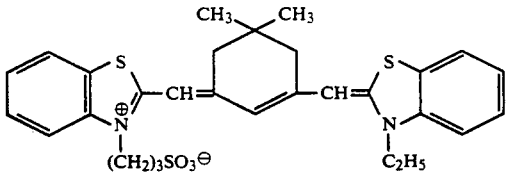
RS-8
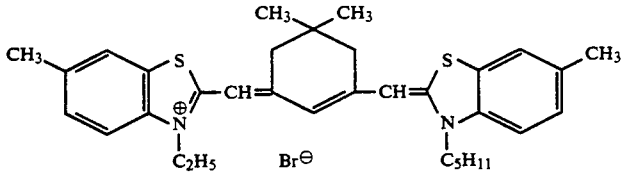
RS-9
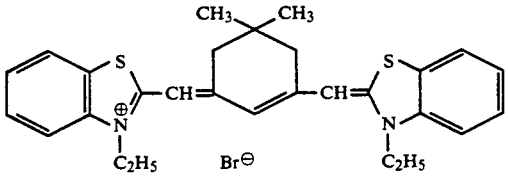

Specific compounds of IR-sensitizing dyes to be used in the present invention are set forth below, but the present invention is not limited to these compounds.
IRS-1
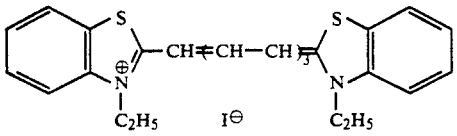
IRS-2
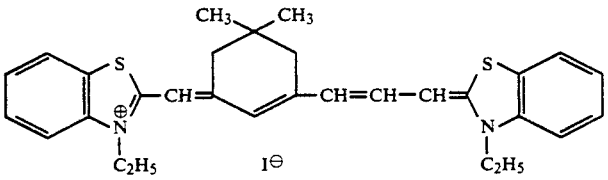
IRS-3
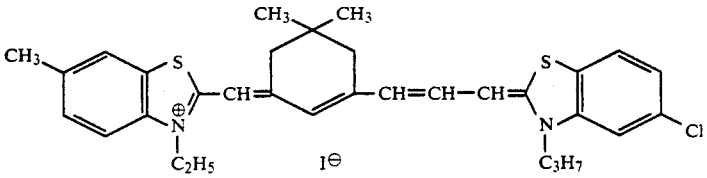
IRS-4
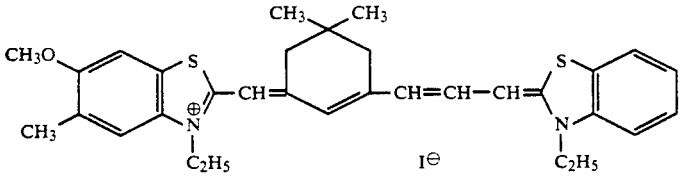
IRS-5
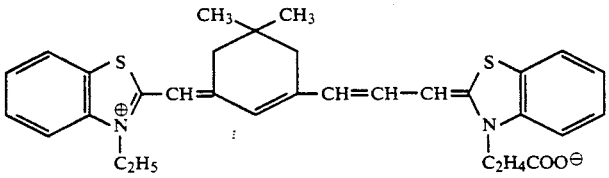
IRS-6
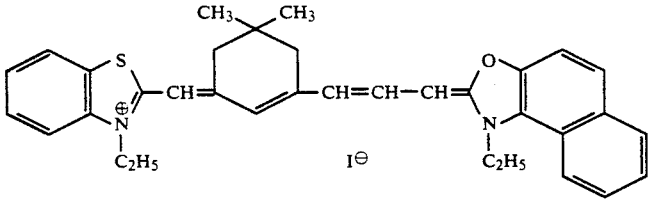
IRS-7
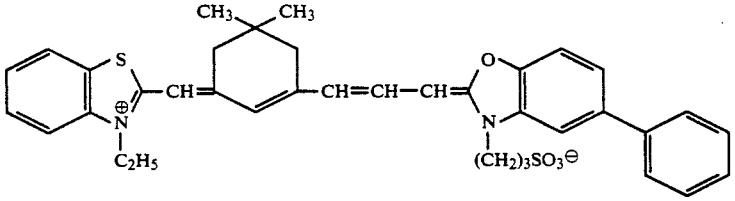
IRS-8
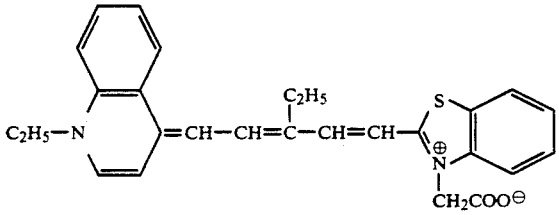

-continued
IRS-9
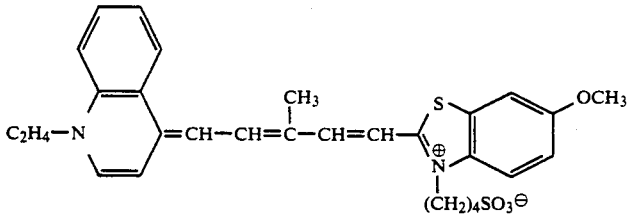
IRS-10
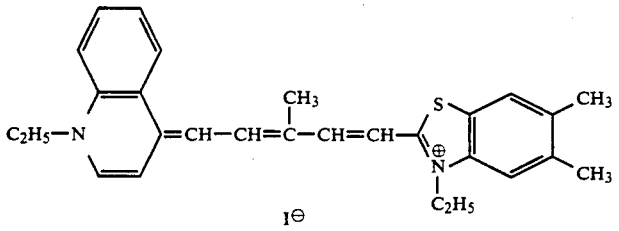
The red-sensitive sensitizing dye and IR-sensitive sensitizing dye can be used in combination with the following compounds as the strengthening sensitizing agent.
SS-1
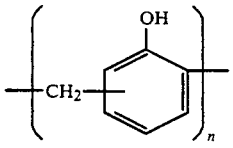
SS-2
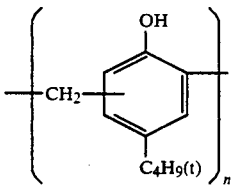
SS-3
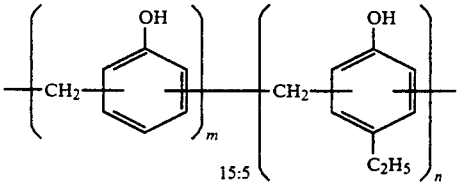
SS-4
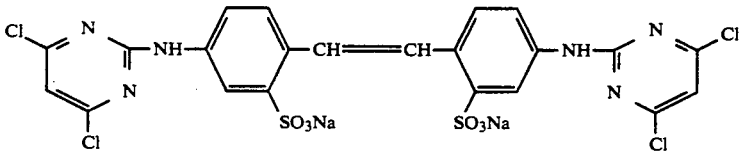
SS-5
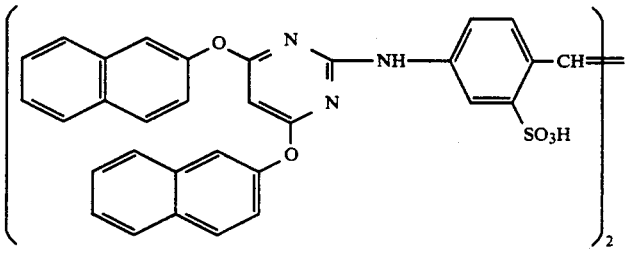

-continued

SS-6

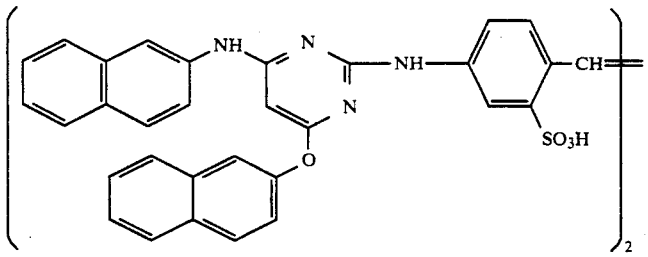

SS-7

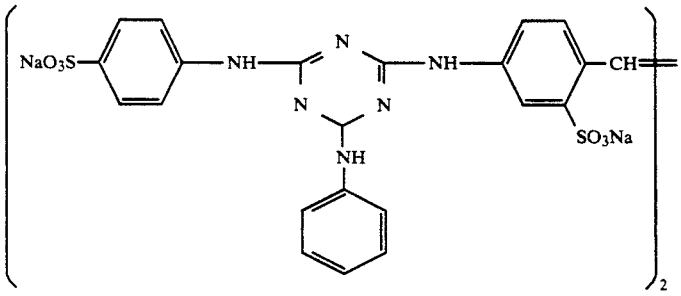

SS-8

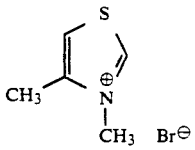

SS-9

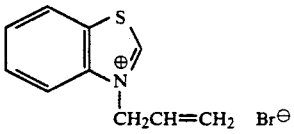

EXAMPLE 1

On a support having a polyethylene laminated on surface of a paper support and a polyethylene containing titanium oxide on the other surface, the respective layers with the consitutions shown below were provided by coating on the side of the polyethylene layer containing titanium oxide to prepare a multi-layer light-sensitive silver halide color photographic material sample No. 101. The coating liquid was prepared as described below.

First layer coating liquid:

To a yellow coupler (YC-8) 26.7 g, dye image stabilizers (ST-1) 10.0 g, (ST-2) 6.67 g, an additive (HQ-1) 0.67 g and a high boiling organic solvent (DNP) 6.67 g was added ethyl acetate 60 ml to dissolve the respective components, and the solution was emulsified into an aqueous gelatin solution 220 ml containing a 20% surfactant (SU-1) 7 ml by use of a sonication homogenizer to prepare a yellow coupler dispersion. The dispersion was mixed with a blue-sensitive silver halide emulsion (containing silver 10 g) to prepare a first layer coating liquid.

The second layer to the seventh layer coating liquids were prepared similarly as in the above first layer coating liquid.

Also, as the film hardener, (H-1) was added into the second layer and the fourth layer and (H-2) into the seventh layer. As the coating aid, surfactants (SU-2), (SU-3) were added to control surface tension.

| Layer | Constitution | Amount added ($g/m^2$) |
|---|---|---|
| Seventh layer (protective | Gelatin | 1.00 |

-continued

| Layer | Constitution | Amount added ($g/m^2$) |
|---|---|---|
| layer) | | |
| Sixth layer (UV-ray absorptive layer | Gelatin | 0.40 |
| | UV-ray absorber (UV-1) | 0.10 |
| | UV-ray absorber (UV-2) | 0.04 |
| | UV-ray absorber (UV-3) | 0.16 |
| | Anti-stain agent (HQ-1) | 0.01 |
| | DNP | 0.20 |
| | PVP | 0.03 |
| | Anti-irradiation dye (AI-2) | 0.02 |
| Fifth layer (red-sensitive layer) | Gelatin | 1.30 |
| | Red-sensitive silve chlorobromide emulsion (Em-R) | 0.21 |
| | Cyan coupler (CC-1) | 0.42 |
| | Dye image stabilizer (ST-1) | 0.20 |
| | Anti-stain agent (HQ-1) | 0.01 |
| | DOP | 0.20 |
| Fourth layer (UV-ray absorptive layer) | Gelatin | 0.94 |
| | UV-ray absorber (UV-1) | 0.28 |
| | UV-ray absorber (UV-2) | 0.09 |
| | UV-ray absorber (UV-3) | 0.38 |
| | Anti-stain agent (HQ-1) | 0.03 |
| | DNP | 0.40 |
| Third layer (Green-sensitive layer) | Gelatin | 1.40 |
| | Green-sensitive silver chlorobromide emulsion (Em-G) | 0.17 |
| | Magenta coupler (MC-8) | 0.35 |
| | Dye image stabilizer (ST-3) | 0.15 |
| | Dye image stabilizer (ST-4) | 0.15 |
| | Dye image stabilizer (ST-5) | 0.15 |
| | DNP | 0.20 |
| | Anti-irradiation dye (AI-1) | 0.02 |
| Second layer (Intermediate layer) | Gelatin | 1.20 |
| | Anti-stain agent (HQ-2) | 0.12 |
| | DIDP | 0.15 |
| First layer (Blue-sensitive layer) | Gelatin | 1.20 |
| | Blue-sensitive silver chlorobromide emulsion (Em-B) | 0.26 |
| | Yellow coupler (YC-8) | 0.80 |
| | Dye image stabilizer (ST-1) | 0.30 |
| | Dye image stabilizer (ST-2) | 0.20 |

-continued

| Layer | Constitution | Amount added ($g/m^2$) |
|---|---|---|
| | Anti-stain agent (HQ-1) | 0.02 |
| | Anti-irradiation dye (AI-3) | 0.01 |
| | DNP | 0.20 |

-continued

| Layer | Constitution | Amount added ($g/m^2$) |
|---|---|---|
| Support | Polyethylene-laminated paper | |

The amount of the silver halide emulsion added is shown as calculated on silver.

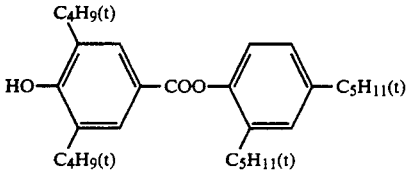

ST-1

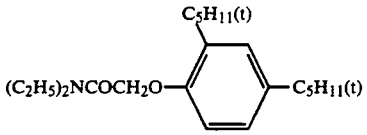

ST-2

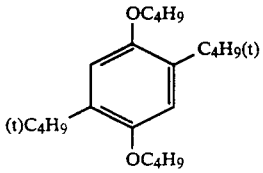

ST-3

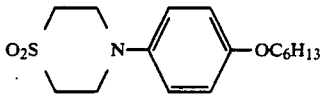

ST-4

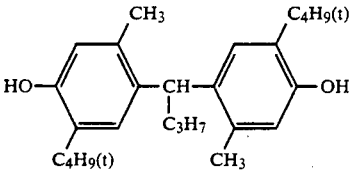

ST-5

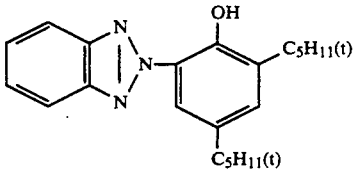

UV-1

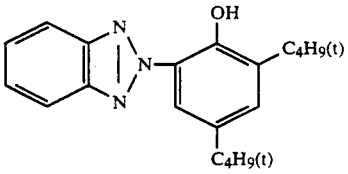

UV-2

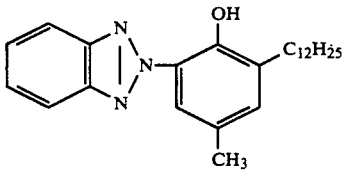

UV-3

DOP dioctyl phthalate
DIDP diisodecyl phthalate

DNP dinonyl phthalate
PVP polyvinyl pyrrolidone

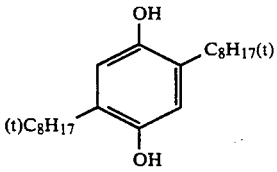

HQ-1

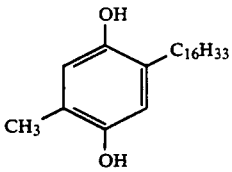

HQ-2

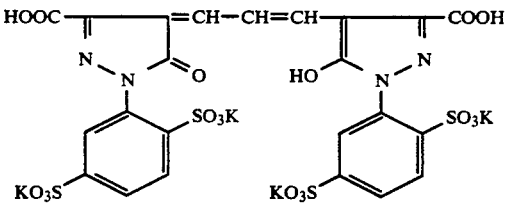

AI-1

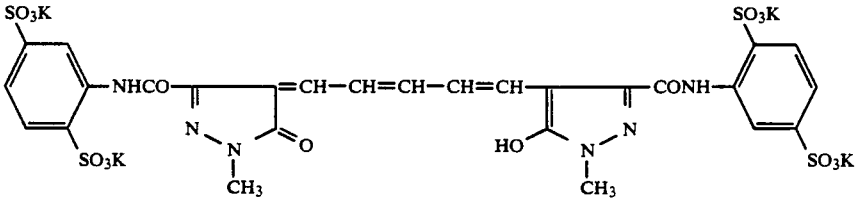

AI-2

-continued

AI-3

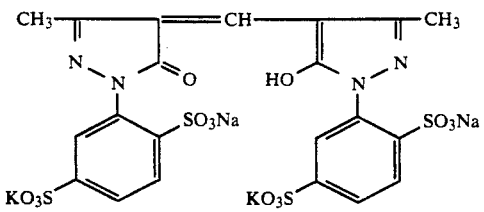

SU-1

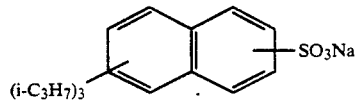

SU-2

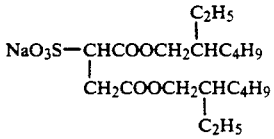

SU-3

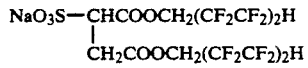

H-1

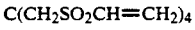

H-2

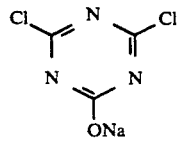

Method for Preparing Blue-Sensitive Silver Halide Emulsion

Into a 2% aqueous gelatin solution 1000 ml maintained at 40° C. were added the (Solution A) and (Solution B) shown below at the same time over 30 minutes while controlling pAg=6.5, pH=3.0, and further (Solution C) and (Solution D) were added at the same time over 180 minutes while controlling pAg=7.3, pH=5.5. At this time, pAg was controlled according to the method described in Japanese Unexamined Patent Publication No. 45437/1984, and pH controlled by use of an aqueous solution of sulfuric acid or sodium hydroxide.

| | |
|---|---|
| (Solution A) | |
| Sodium chloride | 3.42 g |
| Potassium bromide | 0.03 g |
| Water added to | 200 ml |
| (Solution B) | |
| Silver nitrate | 10 g |
| Water added to | 200 ml |
| (Solution C) | |
| Sodium chloride | 102.7 g |
| Potassium bromide | 1.0 g |
| Water added to | 600 ml |
| (Solution D) | |
| Silver nitrate | 300 g |
| Water added to | 600 ml |

After completion of the addition, desalting was performed by use of a 5% aqueous solution of Demol N produced by Kao-Atlas and a 20% aqueous solution of magnesium sulfate, the mixture was mixed with an aqueous gelatin solution to obtain a mono-dispersed cubic emulsion EMP-1 with an average grain size of 0.85 μm, a fluctuation coefficient (S/r)=0.07 and a silver chloride content of 99.5 mole %.

The above emulsion EMP-1 was chemically aged by use of the following compounds at 50° C. for 90 minutes to obtain a blue-sensitive silver halide emulsion (Em-B).

| | |
|---|---|
| Sodium thiosulfate | 0.8 mg/mole AgX |
| Chloroauric acid | 0.5 mg/mole AgX |
| Stabilizer STAB-1 | $6 \times 10^{-4}$ mole/mole AgX |
| Sensitizing dye BS-4 | $4 \times 10^{-4}$ mole/mole AgX |

-continued

| | |
|---|---|
| Sensitizing dye BS-9 | $1 \times 10^{-4}$ mole/mole AgX |

Method for Preparing Green-Sensitive Silver Halide Emulsion

In the same manner as EMP-1 except for changing the addition time of (Solution A) and (Solution B) and the addition time of (Solution C) and (Solution D), a mono-dispersed cubic emulsion EMP-2 with an average grain size of 0.43 μm, a fluctuation coefficient (S/r)=0.08 and a silver chloride content of 99.5 mole % was obtained.

EMP-2 was chemically aged by use of the compounds shown below at 55° C. for 120 minutes to obtain a green-sensitive silver halide emulsion (Em-G).

| | |
|---|---|
| Sodium thiosulfate | 1.5 mg/mole AgX |
| Chloroauric acid | 1.0 mg/mole AgX |
| Stabilizer STAB-1 | $6 \times 10^{-4}$ mole/mole AgX |
| Sensitizing dye GS-1 | $4 \times 10^{-4}$ mole/mole AgX |

Method for Preparing Red-Sensitive Silver Halide Emulsion

In the same manner as EMP-1 except for changing the addition time of (Solution A) and (Solution B) and the addition time of (Solution C) and (Solution D), a mono-dispersed cubic emulsion EMP-3 with an average grain size of 0.50 μm, a fluctuation coefficient (S/r)=0.08 and a silver chloride content of 99.5 mole % was obtained.

EMP-3 was chemically aged by use of the compounds shown below at 60° C. for 90 minutes to obtain a red-sensitive silver halide emulsion (Em-R).

| | |
|---|---|
| Sodium thiosulfate | 1.8 mg/mole AgX |
| Chloroauric acid | 2.0 mg/mole AgX |
| Stabilizer STAB-1 | $6 \times 10^{-4}$ mole/mole AgX |
| Sensitizing dye RS-9 | $1 \times 10^{-4}$ mole/mole AgX |

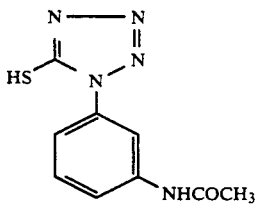

STAB-1

This sample was subjected to resolving exposure at various exposure doses by use of Ratten No. 29 red filter (produced by Eastman Kodak), and processed according to the following processing steps. Also, unexposed sample was similarly processed to prepare a white patch.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30–34° C. | 90 sce. |
| Drying | 60–80° C. | 60 sec. |

| Color developing solution | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-diphosphonic acid | 1.0 g |
| Ethylenediaminetetraacetic acid | 1.0 g |
| Catechol-3,5-disulfonic acid disodium salt | 1.0 g |
| N-ethyl-N-β-metnahesulfonamidoethyl-3-methyl-4-aminoaniline sulfate | 4.5 g |
| Fluorescent brightener (4,4'-diamino-stilbene disulfonic acid derivative) | 1.0 g |
| Potassium carbonate | 27 g |

The total amount is made up to one liter with addition of water and pH is adjusted to pH=10.

| Bleach-fixing solution | |
|---|---|
| Ferric ammonium ethylenediaminetetra-acetate dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |

The total amount is made up to one liter with addition of water, and pH is adjusted to pH=5.7 with potassium carbonate or glacial acetic acid.

| Stabilizing solution | |
|---|---|
| 5-Chloro-2-methyl-4-isothiazolin-3-one | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (20% aqueous solution) | 3.0 g |
| Fluorescent brightener (4,4-diaminostilbene disulfonic acid derivative) | 1.5 g |

The total amount is made up to one liter with addition of water and pH is adjusted to pH=7.0 with sulfuric acid or potassium hydroxide.

By a 607 Model color analyzer (produced by Hitachi Seisakusho K.K.), spectral absorptions of the respective patches were measured, and on the basis of the values measured, L*a*b* was calculated according to the method of JIS Z-8729, and then according to the method of JIS Z-8730, the color difference ΔE from white patch was calculated. The same sample was measured by a PDA-65 densitometer (produced by Konica K.K.) to determine the ΔE when the cyan image density is 0.4.

Next, by varying variously the cyan color forming coupler, light-sensitive silver halide color photographic materials were prepared according to the method as described above, and ΔE when the cyan image density 0.4 was determined. However, the amounts of the silver halide and the coupler added were varied so that substantially equal gray gradation could be obtained. The ΔE values of the respective couplers determined by use of this sample are shown in the following Table 1. However, when a cyan color forming coupler was used in combination, it was used in equal moles in combination.

TABLE 1

| Sample No. | Cyan color forming coupler | ΔE | Sample No. | Cyan color forming coupler | ΔE |
|---|---|---|---|---|---|
| 101 | CC-1 | 19.0 | 106 | CC-12 | 23.2 |
| 102 | CC-3 | 18.7 | 107 | CC-13 | 25.0 |
| 103 | CC-8 | 21.2 | 108 | CC-14 | 25.7 |
| 104 | CC-9 | 17.4 | 109 | CC-3/CC-8 | 19.0 |
| 105 | CC-11 | 20.1 | 110 | CC-3/CC-14 | 23.7 |

EXAMPLE 2

For Samples No. 101–110 prepared in Example 1, by use of the color negatives having the 4 scenes shown below photographed, color prints were prepared, which were presented to a test panel of 10 members and evaluated at 5 stages of very excellent (score 5), excellent (score 4), common (score 3), slightly inferior (score 2), inferior (score 1) by evaluating comprehensively presence of redsaturation phenomenon, three-dimensional feel, sharpness of image, brilliance-of color, etc., and an average value was determined.

The results are shown below in Table 2.

(Scene 1) portrait of a woman wearing a red sweater.
(Scene 2) group portrait.
(Scene 3) landscape of mountain (natural landscape).
(Scene 4) landscape of playland (artificial landscape).

TABLE 2

| Sample No. | Cyan color forming coupler | ΔE | Photographed scene 1 | 2 | 3 | 4 |
|---|---|---|---|---|---|---|
| 101 | CC-1 | 19.0 | 3.1 | 2.9 | 3.2 | 2.9 |
| 102 | CC-3 | 18.7 | 2.8 | 2.7 | 3.0 | 2.8 |
| 103 | CC-8 | 21.2 | 3.0 | 3.0 | 3.5 | 2.9 |
| 104 | CC-9 | 17.4 | 2.6 | 2.8 | 2.9 | 2.7 |
| 105 | CC-11 | 20.1 | 3.2 | 3.3 | 3.2 | 3.2 |
| 106 | CC-12 | 23.2 | 4.1 | 4.3 | 4.2 | 4.2 |
| 107 | CC-13 | 25.0 | 4.5 | 4.4 | 4.5 | 4.4 |
| 108 | CC-14 | 25.7 | 4.8 | 4.8 | 4.2 | 4.7 |
| 109 | CC-3/CC-8 | 19.0 | 2.7 | 2.9 | 3.8 | 3.0 |
| 110 | CC-3/CC-14 | 23.7 | 4.4 | 4.5 | 4.0 | 4.4 |

As shown in Table 2, when a light-sensitive silver halide color photographic material with a color difference of 23 or more at a cyan image density of 0.4 is employed, it can be understood a print image having excellent image quality as seen from such standpoints of cancellation of red saturation phenomenon, three-dimensional feel, sharpness of image can be obtained. This effect depends on the scene, and the effect was found to be great in artificial landscape of playland, etc., group portrait, portrait of a person wearing red sweater, etc.

Particularly, the knitted pattern of the red sweater in the Scene 1, the three-dimensional feel of the face in the group portrait in the Scene 2 appeared well to give excellent descriptions.

Those with ΔE of 25 or more were found to have particularly excellent effects.

EXAMPLE 3

In preparation of Sample No. 102 in Example 1, a cyan color forming coupler CC-3 was added into the third layer in an amount of 5 mole % based on the magenta color forming coupler, and the cyan color forming coupler corresponding thereto was reduced from the cyan color forming coupler added into the fifth layer to prepare Sample No. 301.

Next, in preparation of Sample No. 102 in Example 1, during preparation of the red-sensitive emulsion in the fifth layer, $5\times10^{-5}$ mole of a sensitizing dye RS-8 was added per 1 mole of the silver halide to prepare a red-sensitive emulsion, following otherwise the same procedure to prepare Sample No. 302.

Together with Samples No. 102, 107, color prints were prepared from the above Samples No. 301, 302 similarly as described in Example 2 and evaluated.

The results are shown in Table 3.

TABLE 3

| Sample No. | Cyan color forming coupler | ΔE | Photographed scene 1 | 2 | 3 | 4 |
|---|---|---|---|---|---|---|
| 102 | CC-3 | 18.7 | 2.8 | 2.7 | 3.0 | 2.8 |
| 107 | CC-13 | 25.0 | 4.5 | 4.4 | 4.5 | 4.4 |
| 301 | CC-3 | 18.7 | 3.4 | 2.6 | 3.1 | 2.2 |
| 302 | CC-3 | 18.7 | 3.4 | 2.5 | 3.2 | 2.0 |

As shown in Table 3, in Control Samples No. 301, 302, cancellation of red saturation in a scene such as Scene 1 is not also sufficient, but reproduction of red became darkly sunken, and therefore evaluation was not so high, although slight improvement could be recognized. Particularly, in Scene 2, no effect could be recognized at all, and in Scene 4 , brilliant red was uniformly darkly sunken, whereby evaluation became rather lowered.

In contrast, it can be understood that in the light-sensitive material according to the present invention, reproduction of brilliant red color and delicate shade as well as description of three-dimensional feel of image could be both obtained to give excellent image quality.

EXAMPLE 4

In Samples No. 101, 110 in Example 1, the magenta color forming couplers used in the third layer were variously changed as in Table 4, and the coated amounts of the coupler and the silver halide emulsion were changed so that the gray gradation might be equal, following otherwise the same procedure, to prepare light-sensitive color photographic materials.

The sample was subjected to resolving exposures at various exposure doses by use of Wratten No. 99 green filter (produced by Eastman Kodak), then to the same developing processing as in Example 1, and the spectral absorptions of the respective patches were measured by a 607 Model color analyzer to determine L*a*b*, followed by calculation of the color difference ΔE from the white patch. The maximum values ΔEmax of ΔE at this time are shown in Table 4.

These samples were evaluated in the same manner as in Example 2.

TABLE 4

| Sample No. | ΔE at cyan color forming coupler density of 0.4 | | ΔE max of magenta color forming coupler | | Photographed scene 1 | 2 | 3 | 4 |
|---|---|---|---|---|---|---|---|---|
| 101 | CC-1 | 19.0 | MC-8 | 91.8 | 3.1 | 2.9 | 3.2 | 2.9 |
| 110 | CC/3/CC-14 | 23.7 | MC-8 | 91.8 | 4.4 | 4.5 | 4.0 | 4.4 |
| 401 | CC-3/CC-14 | 23.7 | MC-3 | 78.3 | 4.0 | 4.4 | 3.9 | 4.1 |
| 402 | CC-3/CC-14 | 23.7 | MC-7 | 80.3 | 4.1 | 4.4 | 3.9 | 4.0 |
| 403 | CC-3/CC-14 | 23.7 | MC-9 | 92.0 | 4.5 | 4.5 | 4.0 | 4.6 |
| 404 | CC-3/CC-14 | 23.7 | MC-11 | 93.2 | 4.7 | 4.4 | 4.1 | 4.6 |
| 405 | CC-1 | 19.0 | MC-3 | 78.3 | 2.7 | 2.8 | 3.4 | 2.8 |
| 406 | CC-1 | 19.0 | MC-9 | 92.0 | 3.2 | 2.9 | 3.2 | 3.0 |

As is apparent from Table 4, of the magenta color forming couplers, Samples No. 110, 403, 404 prepared by combination of one with ΔEmax≧90 are bright and brilliant in reproduction of red color, and in addition thereto, also from the standpoint of cancellation of red saturation phenomenon and description of three-dimensional feel, the effect is further greater to give by far higher evaluation.

EXAMPLE 5

In preparation of Sample No. 101 in Example 1, the cyan color forming coupler CC-1 was changed to 2-fold amount in moles of CC-6, DOP was changed to 4-fold amount of dibutyl phthalate (DBP) to prepare Sample No. 501, the cyan color forming coupler CC-1 changed to 2-fold amount in moles of CC-8, DOP increased to 4-fold amount and further a spectral absorption controller (A'-1) added in an amount of 0.40 g/m$^2$ to prepare Sample No. 502, the cyan color forming coupler CC-1 changed to 2-fold amount in moles of CC-10, and DOP to 4-fold of a spectral absorption controller (d-4) to prepare Sample No. 503.

When ΔE at cyan image density 0.4 was determined similarly as in Example 1, the respective values were found to be 23.1, 23.5 and 23.2.

When prints were prepared from these similarly as in Example 2, and evaluated from the standpoints of three-dimensional feel of description of face, cancellation of red saturation phenomenon, whereby it was confirmed that the effect of the present invention could be obtained.

EXAMPLE 6

For the silver halide emulsion EMP-2 in Example 1, chemical aging was effected by use of the following compounds at 55° C. to obtain a red-sensitive emulsion.

| | |
|---|---|
| Sodium thiosulfate | 1.5 mg/mole AgX |
| Chloroauric acid | 1.0 mg/mole AgX |

-continued

| | |
|---|---|
| Stabilizer STAB-1 | $6 \times 10^{-4}$ mole/mole AgX |

STAB-1 was added in a time which give the optimum sensitometry performance, and the chemical aging was stopped by lowering the temperature, and 3 minutes before addition of STAB-1, $1 \times 10^{-4}$ mole/mole AgX of a sensitizing dye IRS-6 and 0.7 g/mole AgX of a strengthening sensitizer SS-1 were added to prepare the emulsiotn.

The blue-sensitive emulsion in Samples No. 102, 107 in Example 1 was replaced with the above red-sensitive emulsion to prepare light-sensitive silver halide photographic Samples No. 601, 602.

Samples No. 102, 107 were subjected to scanning exposure by use of helium neon at 633 nm, 544 nm, and helium cadmium laser at 442 nm, and Samples No. 601, 602 by use of helium neon at 633 nm, 544 nm and gallium aluminum arsenic semiconductor laser at 780 nm to modulate suitably the output, thereby forming images.

As to the exposure conditions at this time, an apparatus was assembled so that a light flux with a pitch of 100 μm and a diameter of 80 μ (the place where the light intensity becomes ½ of the maximum value in the spatial change of the intensity of laser beam flux is made the outer brim, and the distance between the two points where the line in parallel to the scanning line and passing the point where the light intensity becomes maximum crosses the outer brim of the light flux is made the diameter) can be scanning exposed at a scanning speed of 1.6 m/sec.

The exposure time defined by this time (diameter of light flux/scanning speed) was $5 \times 10^{-5}$ sec.

The color paper after completion of exposure was subjected to developing processing according to the method described in Example 1 to obtain a color print. For the scenes, approximately the same scenes as used in Example 2 were employed, and the print sample was presented to a test panel of 10 members for visual observation.

As the result, the light-sensitive silver halide photogaphic materials No. 107, 602 according to the present invention were found to be more excellent in color reproducibility as compared with Comparative samples No. 102, 601, and a print image excellent in description of with delicate shade in detail such as the knitted pattern of sweater, description of three-dimensional feel of face could be obtained.

Thus, also by the image forming method which forms an image by scanning exposure by use of digital data, the effect of the present invention was confirmed to be obtained.

We claim:

1. In a light-sensitive silver halide color photographic material having at least three kinds of silver halide emulsion layers with different color sensitivities on a reflective support, said layers having yellow, magenta and cyan color forming couplers for forming colors upon exposure and development and the improvement wherein, when the coupler for forming color related to said color sensitive silver halide emulsion layer primarily forming the cyan color image is exposed and developed to a cyan image density of 0.4, the color difference (color difference ΔE in the CEI 1976 L*a*b color space) from the minimum density is $\Delta E \geqq 23$.

2. The material of claim 1 wherein said yellow coupler is a yellow coupler represented by following formula (Y-I):

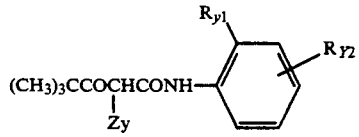

wherein $R_{y1}$ represents a halogen atom or an alkoxy group, $R_{y2}$ represents $-NHCOR_{y3}SO_2R_{y4}$, $-COOR_{y4}$, $-NHCOR_{y4}$, $-COOR_{y3}COOR_{y4}$,

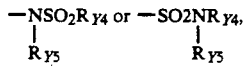

$R_{y3}$ represents an alkylene group, $R_{y4}$ represents a diffusion resistant group, $R_{y5}$ represents a hydrogen atom or an alkyl group , and $Z_y$ represents a coupling elimination group.

3. The material of claim 1 wherein said yellow coupler comprises at least one yellow coupler selected from the group consisting of

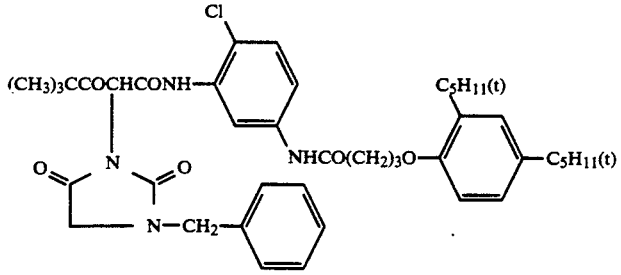

YC-1

-continued
YC-2
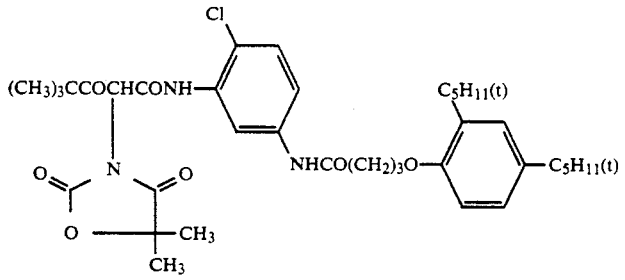
YC-3
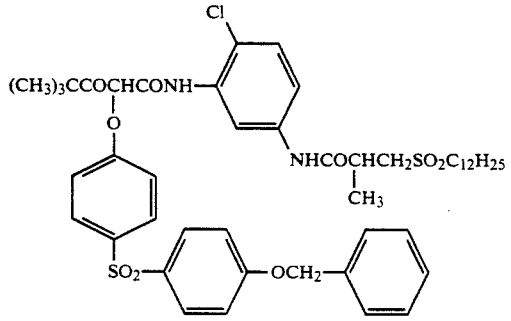
YC-4
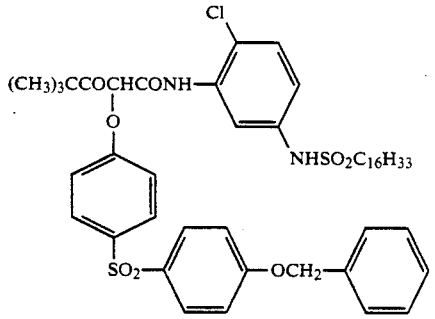
YC-5
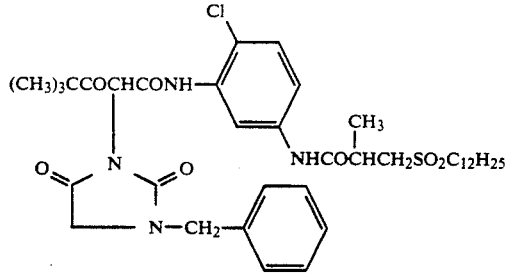
YC-6
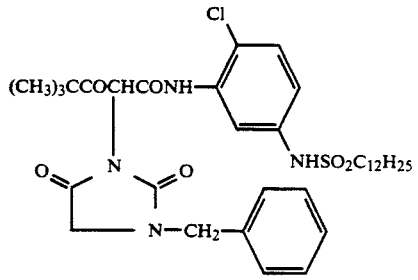

-continued

YC-7

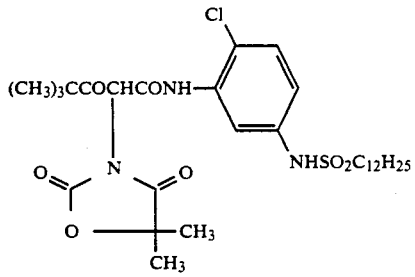

YC-8

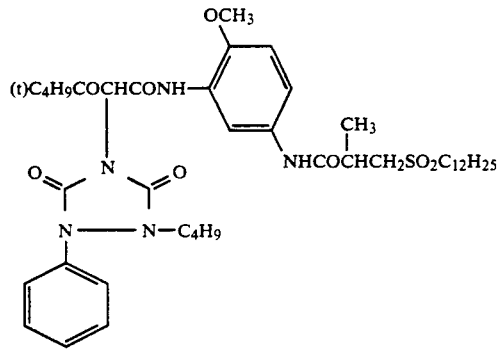

YC-9

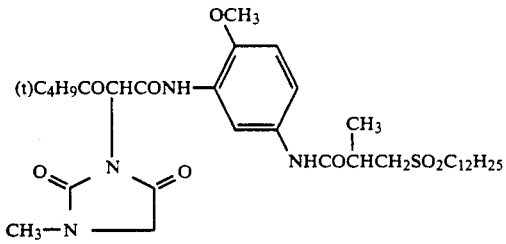

4. The material of claim 1 wherein said magenta coupler is a magenta coupler represented by the following formula (M-I):

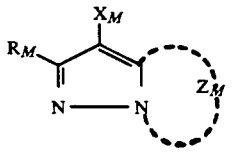

wherein $Z_M$ represents a group of non-metallic atoms necessary for forming a nitrogen-containing heterocyclic ring, $X_M$ represents a hydrogen atom or a group which may be eliminated through reaction with the oxidized product of a color developing agent, and $R_M$ represents a hydrogen atom or a substituent.

5. The material of claim 1 wherein said magenta coupler is a magenta coupler represented by the following formula (M-II):

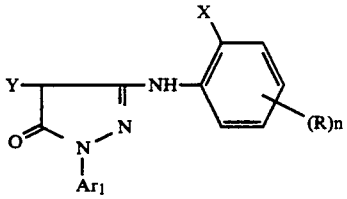

wherein $Ar_1$ represents an aryl group; X represents a halogen atom, an alkoxy group, or an alkyl group; R represents a substituent; n represents 1 or 2, with the proviso that when n is 2, the R groups may be the same or different; and Y represents a group which may be eliminated through a coupling reaction with the oxidized product of a color developing agent.

6. The material of claim 1 wherein said magenta coupler comprises at least one magenta coupler selected from the group consisting of MC-1
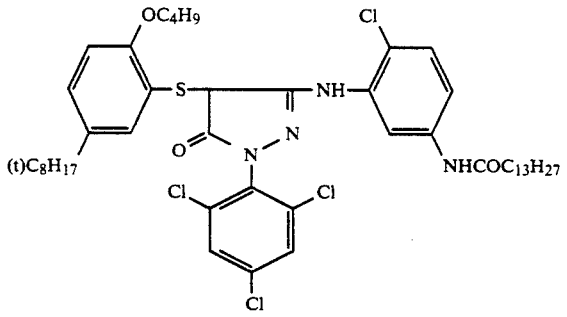
MC-2
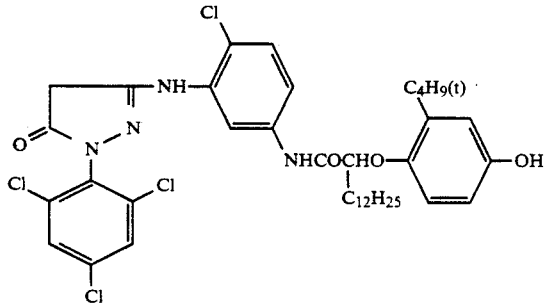
MC-3
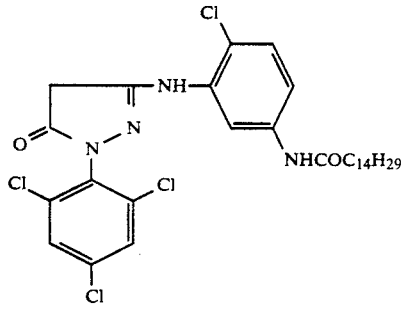
MC-4
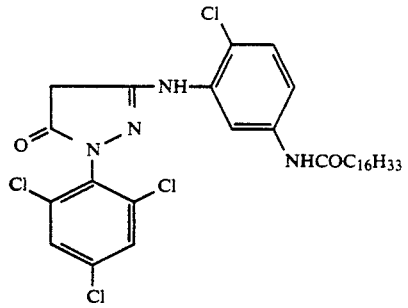
MC-5
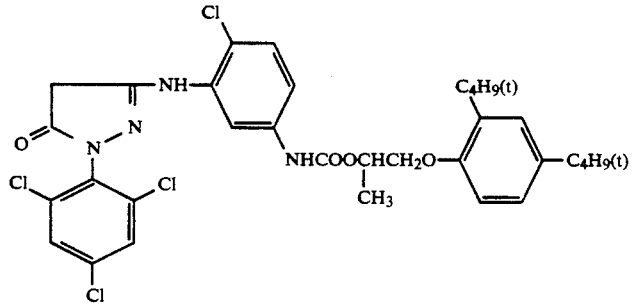

-continued
MC-6
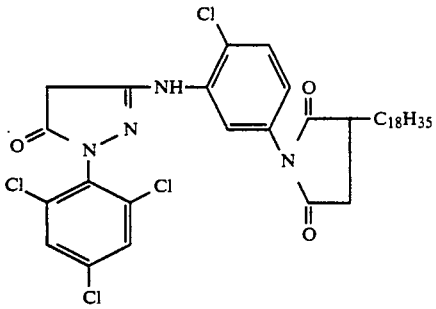
MC-7
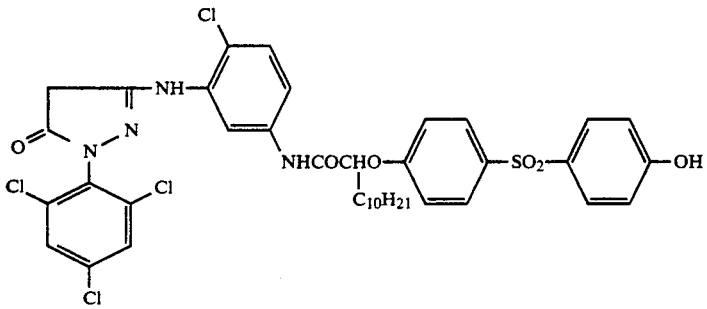
MC-8
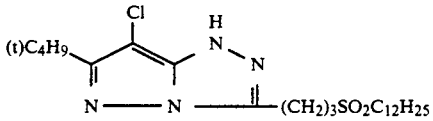
MC-9
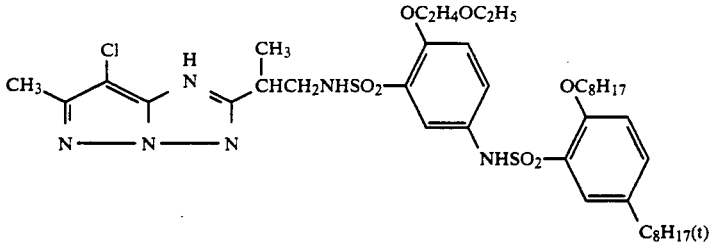
MC-10
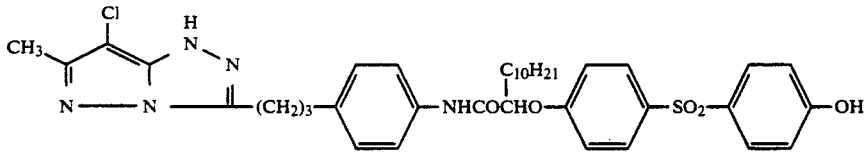
MC-11
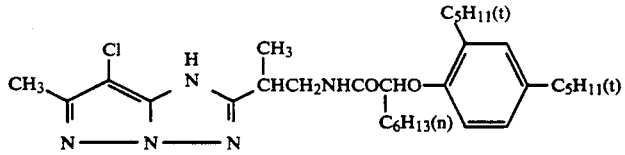
7. The material of claim 1 wherein said magenta coupler has a $\Delta E_{max}$ of $\geqq 90$.
8. The material of claim 2 wherein $R_{Y5}$ is an aralkyl group.
* * * * *